United States Patent [19]

Leung

[11] Patent Number: 4,768,510

[45] Date of Patent: Sep. 6, 1988

[54] PACIFIER

[76] Inventor: Wilson Leung, 1504 Tower 1, Silvercord Canton Rd., Tsimshatsu, Cowloon, Hong Kong

[21] Appl. No.: 5,748

[22] Filed: Jan. 21, 1987

[51] Int. Cl.[4] ..... A61J 17/00

[52] U.S. Cl. ..... 128/360; 128/359

[58] Field of Search ..... 128/359, 360

[56] References Cited

U.S. PATENT DOCUMENTS

| | | |
|---|---|---|
| 404,950 | 6/1889 | Barnes . |
| 457,259 | 8/1891 | Decoeur . |
| 482,786 | 9/1892 | Crocker . |
| 1,092,862 | 4/1914 | Roitman . |
| 1,122,306 | 12/1914 | Reschke . |
| 1,467,904 | 9/1923 | McOmish . |
| 2,519,324 | 8/1950 | Smith, Jr. . |
| 2,717,473 | 9/1955 | Moore . |
| 3,923,067 | 12/1975 | Hurst . |
| 4,402,321 | 9/1983 | Berg ..... 128/354 |
| 4,577,632 | 3/1986 | Grasset . |

FOREIGN PATENT DOCUMENTS

| | | |
|---|---|---|
| 1287253 | 11/1965 | Fed. Rep. of Germany ..... 128/360 |

*Primary Examiner*—C. Fred Rosenbaum
*Assistant Examiner*—Mark F. Colosimo
*Attorney, Agent, or Firm*—Christie, Parker & Hale

[57] ABSTRACT

A pacifier is provided for infants. The pacifier includes a nipple, a flexible bulb handle which extends away from the nipple and a shield located between the nipple and the flexible bulb. A whistle is securely mounted to the pacifier by the shield and is located within the flexible bulb handle. When the handle is squeezed, air passes through the whistle to provide a whistle or squeeking sound.

6 Claims, 2 Drawing Sheets

PACIFIER

FIELD OF THE INVENTION

This invention relates to pacifiers for infants which make a whistling or squeaking sound and which include a nipple, a handle extending away from the nipple and a shield located between the nipple and the handle.

BACKGROUND OF THE INVENTION

Various forms of pacifiers had been available over the years. Typical pacifiers included a nipple, a handle extending away from the nipple and a shield located between the nipple and the handle. The nipple provides an infant with something to suck on to pacify him between feedings. The shield is designed to be larger than the opening of the infant's mouth to thereby limit penetration of the device into the mouth to prevent choking.

Various infant playthings have been available over the years that make whistling or squeaking sounds when squeezed. Such devices include those which have a flexible hollow body with a whistle or squeaker mounted in the body surface. As the infant squeezes the device, air is expelled from the interior of the body through the whistle. This provides a whistling sound. As the infant releases the device, air passes back through the whistle into the hollow body. The whistle sounds divert the infant's attention and tend to pacify him.

It is desired to provide a pacifier that includes the conventional nipple, shield and handle arrangement and which also includes a whistle or squeaker. One danger when providing any such device for use by an infant, is that small parts of the device, if they become detached, present a choking hazard. It is therefore desired that the pacifier provided in accordance with practice of this invention be designed to minimize the possibility of any of its parts, especially the whistle (squeaker), becoming detached and finding their way into the infant's mouth.

SUMMARY OF THE INVENTION

A pacifier is provided in accordance with the practice of this invention which is designed to emit a whistle or squeaking sound. The pacifier includes a hollow shield with top and bottom sections. The sections are spaced apart from each other except at their periphery where they are joined together. An opening is through about the center of both shield sections. A nipple is secured at its base in the top section opening and extends vertically away from the shield. A flexible hollow bulb is provided which is open at one end for entry and egress of air. The open end of the bulb is secured to the bottom section opening by means of a whistle assembly which extends through the bottom section opening and into the bulb. At least one orifice, in addition to the center openings, is in one or both of the top or bottom shield sections. Such an orifice permits the venting or air out from the interior of the shield when the bulb is squeezed forcing air from the bulb through the whistle assembly and into the shield. The orifice also permits the air to flow back into the shield, back through the whistle and into the bulb when the bulb is released.

BRIEF DESCRIPTION OF THE DRAWINGS

These and other features, aspects and advantages of the present invention will be more fully understood when considered with respect to the following detailed description, appended claims, and accompanying drawings, wherein:

DETAILED DESCRIPTION

Figure 1:
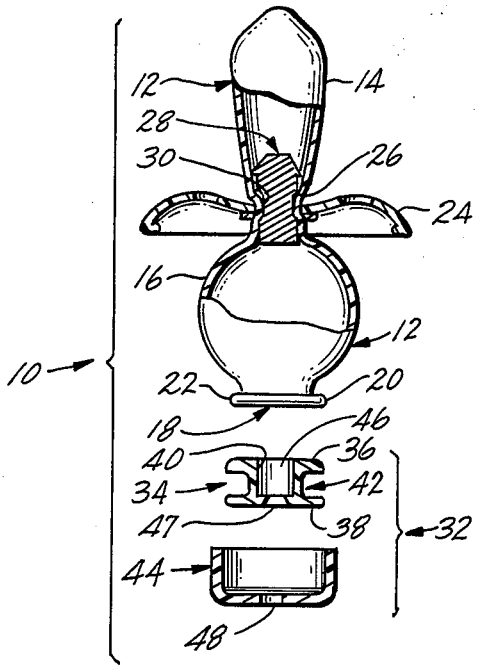
Fig. 1 PRIOR ART
FIG. 1 is a semi-schematic, perspective exploded view in partial cross-section of a prior art pacifier including a whistle assembly.

Referring to FIG. 1, there is shown an exploded semi-schematic view in partial cross-section of a prior art pacifier 10 which is designed to make a whistling or squeaking sound. (As used herein the terms "whistle", "squeak" or "squeaker" means the same thing and thus the terms are used interchangeably.) The pacifier 10 includes a flexible body 12 of synthetic rubber or other polymeric material and is of unitary construction.

Although the prior art pacifier described with reference to FIG. 1 and the pacifier provided in accordance with this invention (shown in FIGS. 2–4) can be held in any position, for purposes of exposition herein, the positions of the pacifier components relative to each other are described as oriented in FIG. 1 for the prior art pacifier and in FIGS. 2 and 3 for the pacifier of this invention.

The prior art pacifier body 12 has a nipple portion 14 on its top end and a bulb portion 16 on its bottom end. The bulb 16 has an opening 18 through its bottom end 20. A roll of material provides a lip or ring 22 around the opening 18. A circular plastic shield 24 is provided with an opening 26 through its center. The pacifier body extends through the opening with the nipple 14 extending vertically away from the shield in an upward direction and the bulb extending vertically away from the shield in a downward direction. A plug 28 is inside the body 12 in a region between the nipple 14 and bulb 16. The plug 28 has a groove 30 extending horizontally around its surface. The groove has a diameter only slightly less than the diameter of the shield opening 26. When the shield is in place, the material in the region between the nipple and the bulb is pinched between the periphery of the shield opening 26 and the groove 30. This friction fit holds the body 12 securely in place in the shield.

A whistle assembly 32 is mounted on the open bottom end 20 of the bulb 16. The whistle assembly 32 includes a hub 34 which has a horizontally extending top flange 36 spaced vertically apart from a horizontally extending bottom flange 38 by a center section 40. The diameter of the center section is less than the diameter of the top and bottom flanges so that a groove 42 is defined between the flanges. When the pacifier is assembled, the material ring 22 is in the groove 42 and is held firmly in place therein by means of a cap 44 which fits tightly over the hub 34. A vertically extending cylindrical passage 46 is through the top flange 36 and the hub center section 40. An orifice 47 is through the center of the bottom flange 38, opening into the passage 46. The orifice 47 is in line with an orifice 48 through the bottom of the cap 44. The passage 46 and orifices 47 and 48 provide a flow path for air between the interior of the bulb 16 and the outside atmosphere.

When an infant is using the prior art pacificer 10 and squeezes the bulb 16, air is forced from the bulb through the passage 46, through the orifice 47 and then through the orifice 48 in the cap. The flow of air through the orifices provides a whistling or squeaking sound. As the bulb is released, air passes back through the orifices into the bulb.

In the above-described prior art pacifier 10, the whistle assembly is sufficiently small so that an infant can put it into his mouth. There is, therefore, a possibility that an infant or small child could bit the whistle from the bulb. Also, one or more parts of the whistle assembly could become detached from the bulb in some other manner. In either case, the whistle could find its way into the infant's or child's mouth and become a choking hazard.

As is described below in detail, the pacifier provided in accordance with the practice of principles of this invention is designed so that the whistle assembly cannot be placed in the infant's mouth and thus, there is no danger that it can become a choking hazard.

Figure 4:
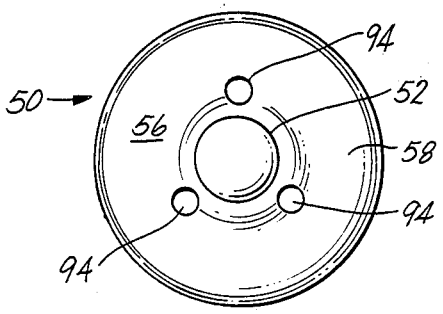
FIG. 4 is a top view of the pacifier shown in FIG. 2.
Figure 3:
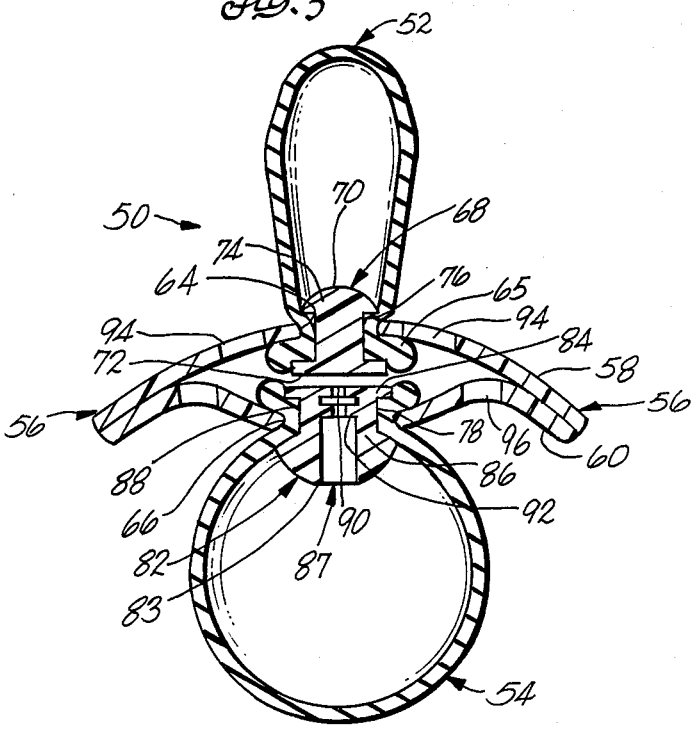
FIG. 3 is a semi-schematic vertical cross-sectional view taken on line 3—3 of FIG. 2.
Figure 2:
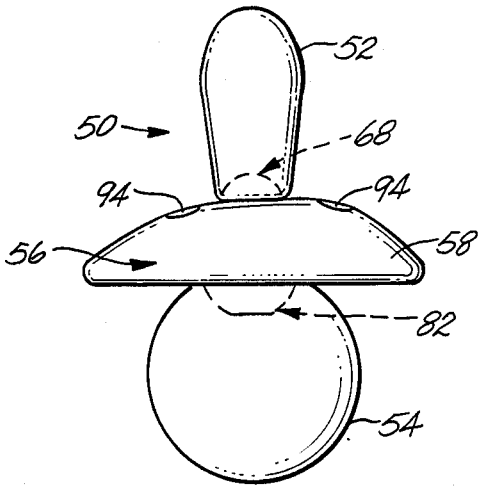
FIG. 2 is a semi-schematic side elevational view of a pacifier provided in accordance with practice of principles of this invention.

Turning to FIGS. 2–4, a pacifier 50 provided in accordacne with practice of principles of this invetnion is shown. The pacifier 50 includes a flexible nipple 52 made of rubber or other flexible polymeric material and a flexible bulb 54 made of the same or similar material which acts as a handle. A shield 56 that has a top section 58 and a bottom section 60 is between the nipple and bulb. The top and bottom sections are spaced apart from each other vertically except at their periphery where they are joined together. Thus the shield is hollow.

An opening 64 is through the center of the shield top section and an opening 66 is through the center of the shield bottom section. In the illustrated embodiment, the top opening is slightly smaller than the bottom opening and the openings are circular and in registry with each other.

The nipple 52 has an open base portion 65 which extends through the opening 64 into the shield. A plug 68 extends through the opening 64 inside the open base 65 of the nipple. The plug holds the nipple securely in place in the shield. In the illustrated embodiment, the plug has a mushroom-shaped top flange 70 spaced apart vertically from a relatively flat bottom flange 72 by a center section 74. The diameter of both the top and bottom flanges is greater than the diameter of the section 74 extending between the flanges so that a groove 76 is defined by the flanges. The material defining the periphery of the opening 64 in the top shield section extends slightly into the groove 76 thereby holding the material of the nipple base securely in the groove 76 by a friction fit. This friction fit anchors the nipple to the shield. If desired, a suitable adhesive can be used to bond the parts together.

An orifice (not shown) can extend vertically through the plug 68 between the interior of the nipple and the interior of the shield so that the pressure inside and outside the nipple remains equal. Having equal pressure inside and outside of the nipple promotes the retention of the nipple's shape.

The flexible hollow bulb 54 has an opening 78 at one end so to provide for entry and egress of air. A whistle assembly 82 extends through the bottom section opening 66. The whistle assembly includes means for securing the open end 78 of the bulb in place in the bottom shield opening 66. In the illustrated embodiment, the whistle assembly includes a mushroom-shaped bottom flange 83 and a relatively flat top flange 84 connected together by a center section 86. The center section has a smaller diameter than either of the flanges 83 or 84. Thus, a groove 88, which extends generally horizontally around the whistle, is defined by the flanges. A cylindrical opening 87 extends vertically through the whistle assembly. Appropriate orifices 90 and 92 are provided in the opening 87 so that when air is forced through the orifices a whistle or squeaking sound is provided. Any suitable orifice design can be used so long as it provides a whistle sound upon the passage of air.

When the pacifier 50 is assembled, the material at the opening 78 of the bulb is held firmly in place in the groove 88 by the flange which defines the perimeter of the shield bottom segment opening 66. If desired a suitable adhesive can be used to bond the part together.

In the illustrated embodiment, three orifices or vents 94 are through the top shield section 58 and three orifices 96 are through the bottom shield section 60. Although three orifices are in each shield section, more or fewer orifices may be provided as desired, so long as at least one orifice is in at least one of the shield sections in addition to the center openings 64 and 66. The orifices 94 and 96 provide for the venting of air from inside the shield as the flexible bulb is squeezed and air passes from the bulb through the orifices 90 and 92 in the opening 87 of the whistle and into the shield. Furthermore, one or more such orifices 94 or 96 are required to permit air to flow back into the shield, back through the whistle assembly and into the bulb when the bulb is released.

As is described above in detail, the pacifier provided in accordance with this invention has a whistle assembly held securely in place by the shield inside the squeeze bulb. The whistle, therefore, cannot be placed into the infant's mouth to be dislodged by biting or the like. Thus, the pacifier of this invention is very safe because there is little or no chance that the whistle will become detached from the assembly to become a choking hazard.

The above description of a pacifier is for illustrative purposes. Because of variations which will be apparent to those skilled in the art, the present invention is not intended to be limited to the particular embodiments described above. The scope of the invention is defined in the following claims.

What is claimed is:

1. A pacifier for infants which emits a whistle sound, the pacifier comprising:

a shield having a top section and a bottom section wherein the top and bottom sections are spaced apart from each other except at the periphery of the sections which are joined together;

an opening through about the center of the shield top section;

a nipple extending vertically away from the shield and secured at its base in the top section opening;

an opening through about the center of the shield bottom section;

a flexible hollow bulb having an opening at one end for entry and egress of air, the open end of the bulb being secured in the bottom section opening and providing for communication between the interior of the bulb and the interior of the shield;

a whistle assembly extending through the bottom section opening into the hollow bulb, the whistle assembly including means for securing the open end of the bulb in place in the bottom section opening; and at least one orifice, in addition to the center openings, in at least one of the shield sections, such an opening to permit the venting or air out from the space between the top and bottom shield sections as the flexible bulb is squeezed forcing air from the bulb through the whistle assembly and into the shield, and to permit air to flow back into the shield, back through the whistle assembly and into the bulb when the bulb is released.

2. A pacifier as is claimed in claim 1 wherein the means for securing the open end of the bulb in place in the bottom section opening includes a generally horizontal groove extending around the outer surface of the whistle assembly so that when the pacifier is assembled, the material of the open end of the bulb is held firmly in place in the groove by the flange defining the perimeter of the shield bottom segment opening.

3. A pacifier as is claimed in claim 1 wherein the shield is circular in horizontal cross-section.

4. A pacifier as is claimed in claim 1 wherein the nipple is secured in the top section opening by means of a plug which extends through the opening inside the nipple, the plug having an opening through its center which communicates between the lines of the nipple and the inside of the shield.

5. A pacifier for infants which emits a whistle sound, the pacifier comprising:

a hollow shield having a first opening through the center of its top and a second opening through the center of its bottom;

a nipple secured at its base in the first opening and extending away from the shield;

a flexible hollow bulb having an open end in communication with the second opening to provide for passage of air between the interior of the bulb and the interior of the shield;

a whistle assembly extending through the second shield opening into the bulb through the bulb open end, the whistle assembly and the periphery of the second opening trapping the material of the open end of the hollow bulb between them to thereby form a press fit which holds the bulb, the whistle assembly and the shield together; and at least one orifice in the shield in addition to the top and bottom center openings to permit venting of air out from the shield as the flexible bulb is squeezed and air is forced from the bulb through the whistle assembly and into the shield, and to permit air to flow back into the shield, back through the whistle assembly and into the bulb when the bulb is released.

6. A pacifier as is claimed in claim 5 wherein the nipple is secured in the top section opening by means of a plug which extends through the opening inside the nipple, the plug having an opening through its center which communicates between the inside of the nipple and the inside of the shield.

* * * * *

UNITED STATES PATENT AND TRADEMARK OFFICE

CERTIFICATE OF CORRECTION

PATENT NO. : 4,768,510

DATED : September 6, 1988

INVENTOR(S) : Wilson Leung

It is certified that error appears in the above-identified patent and that said Letters Patent is hereby corrected as shown below: Title page:

In the Abstract, "squeeking" should be -- squeaking --.

Column 1, line 58, "or" should be -- of --.

Column 3, line 9, "bit" should be -- bite --.

Column 3, lines 20 and 21, "accordacne" should be -- accordance --.

Column 3, line 21, "invetnion" should be -- invention --.

Column 4, line 14, "part" should be -- parts --.

Column 5, line 1, "or" should be -- of --.

Signed and Sealed this

Twenty-first Day of February, 1989

*Attest:*

DONALD J. QUIGG

*Attesting Officer*

*Commissioner of Patents and Trademarks*